United States Patent [19]

Yamamoto

[11] Patent Number: 4,495,879

[45] Date of Patent: Jan. 29, 1985

[54] METHOD AND APPARATUS FOR PRESSING SEAMS OPEN ON SEWING MACHINES

[76] Inventor: Toshiki Yamamoto, Uchida Higashi-cho 4-7, Inuyama-shi, Aichi-ken 484, Japan

[21] Appl. No.: 477,275

[22] Filed: Mar. 21, 1983

[30] Foreign Application Priority Data

May 10, 1982 [JP] Japan ..... 57-078961

[51] Int. Cl.[3] ..... D05B 29/00; D05B 1/02; D05B 35/02; D06F 71/30

[52] U.S. Cl. ..... 112/217; 112/262.1; 38/1 B

[58] Field of Search ..... 112/262.1, 235, 147, 112/217; 38/1 B

[56] References Cited

U.S. PATENT DOCUMENTS

| | | | |
|---|---|---|---|
| 2,587,626 | 3/1952 | Katz et al. | 112/217 |
| 3,587,496 | 6/1971 | Timby | 112/217 |
| 3,934,525 | 1/1976 | Aldred | 112/217 |
| 3,990,163 | 11/1976 | Aulich et al. | 38/1 B |
| 4,016,822 | 4/1977 | Pugliese | 112/217 |

*Primary Examiner*—Henry S. Jaudon
*Assistant Examiner*—A. M. Falik
*Attorney, Agent, or Firm*—Flynn, Thiel, Boutell & Tanis

[57] ABSTRACT

Upper and lower fabric pieces are separated by a presser foot and sewn along a seam with respective edges left therealong. The upper and lower fabric pieces are fed along in a direction by means of a main feed dog. The edge of the upper fabric piece is folded back on the latter by means of a guide member disposed above a throat plate, with the guide member heated to heat the seam. The edge of the lower fabric piece is folded back on the latter below the throat plate by means of a guide rod mounted on the throat plate. The folded edge of the lower fabric piece is lifted up to the throat plate by means of an auxiliary feed dog, and guided onto a bearing plate by means of a guide body movable with the main feed dog. The upper and lower fabric pieces with their folded edges are pressed with heat between a roller and the bearing plate while being moved in said direction by the roller being rotated. Steam is applied against the seam when it is heated by the guide member.

8 Claims, 13 Drawing Figures

METHOD AND APPARATUS FOR PRESSING SEAMS OPEN ON SEWING MACHINES

BACKGROUND OF THE INVENTION

The present invention relates to a method of and an apparatus for pressing a sewn seam open on a sewing machine by stitching overlapped edges of two pieces of fabric, folding back the edges, and pressing the folded edges with heat.

Prior sewing machines are capable of only sewing overlapped pieces of fabric as shown in FIG. 1 of the accompanying drawings. In order to fold back the stitched edges as shown in FIG. 2, it has been necessary in the past to rely solely on manual labor for ironing the seam open, a procedure which adds to the cost due to an expenditure of labor and tends to produce a meandering folded seam on account of the manual finishing, thus failing to yield uniformized sightly products.

SUMMARY OF THE INVENTION

An object of the present invention is to provide a method of and an apparatus for automatically pressing open sewn seams on a sewing machine.

According to the present invention, a pair of upper and lower fabric pieces are separated by a presser foot and sewn along a seam with respective edges left therealong. The upper and lower fabric pieces are fed along in a direction by means of a main feed dog. The edge of the upper fabric piece is folded back on the latter by means of a guide member disposed above a throat plate, with the guide member heated to heat the seam. The edge of the lower fabric piece is folded back on the latter below the throat plate by means of a guide rod mounted on the throat plate. The folded edge of the lower fabric piece is lifted up to the throat plate by means of an auxiliary feed dog, and guided onto a bearing plate by means of a guide body movable with the main feed dog. The upper and lower fabric pieces with their folded edges are pressed with heat between a roller and the bearing plate while being moved in said direction by the roller being rotated. Steam is applied against the seam when it is heated by the guide member.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 1:
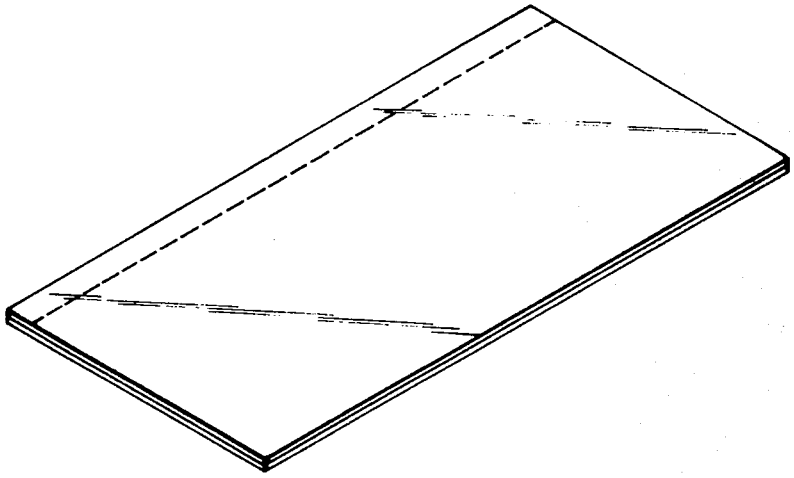
FIG. 1 (PRIOR ART)
FIGS. 1 and 2 are perspective views showing the conventional manner in which two pieces of fabric are sewn together with the seam pressed open.
Figure 2:
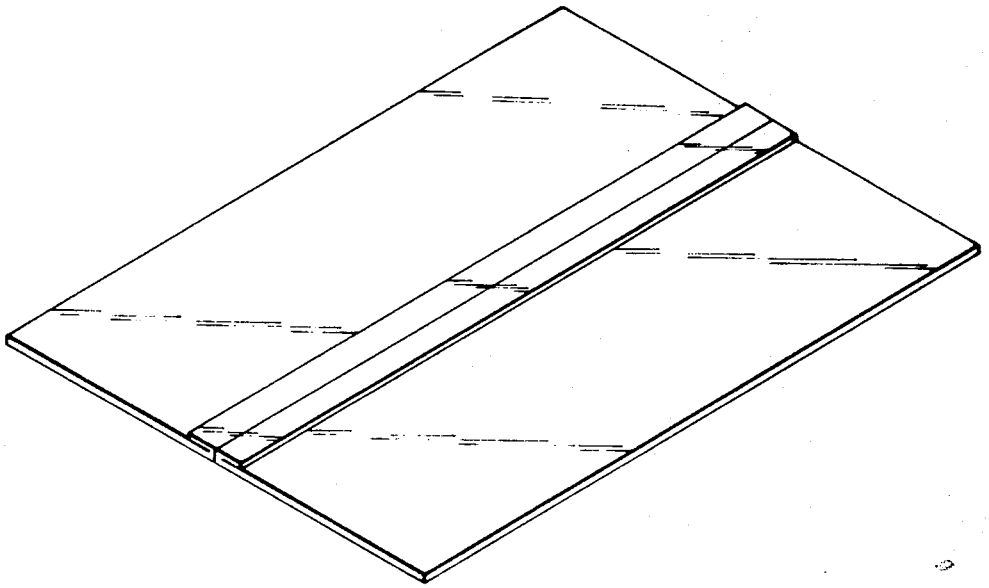
FIG. 2 (PRIOR ART)
Figure 3:
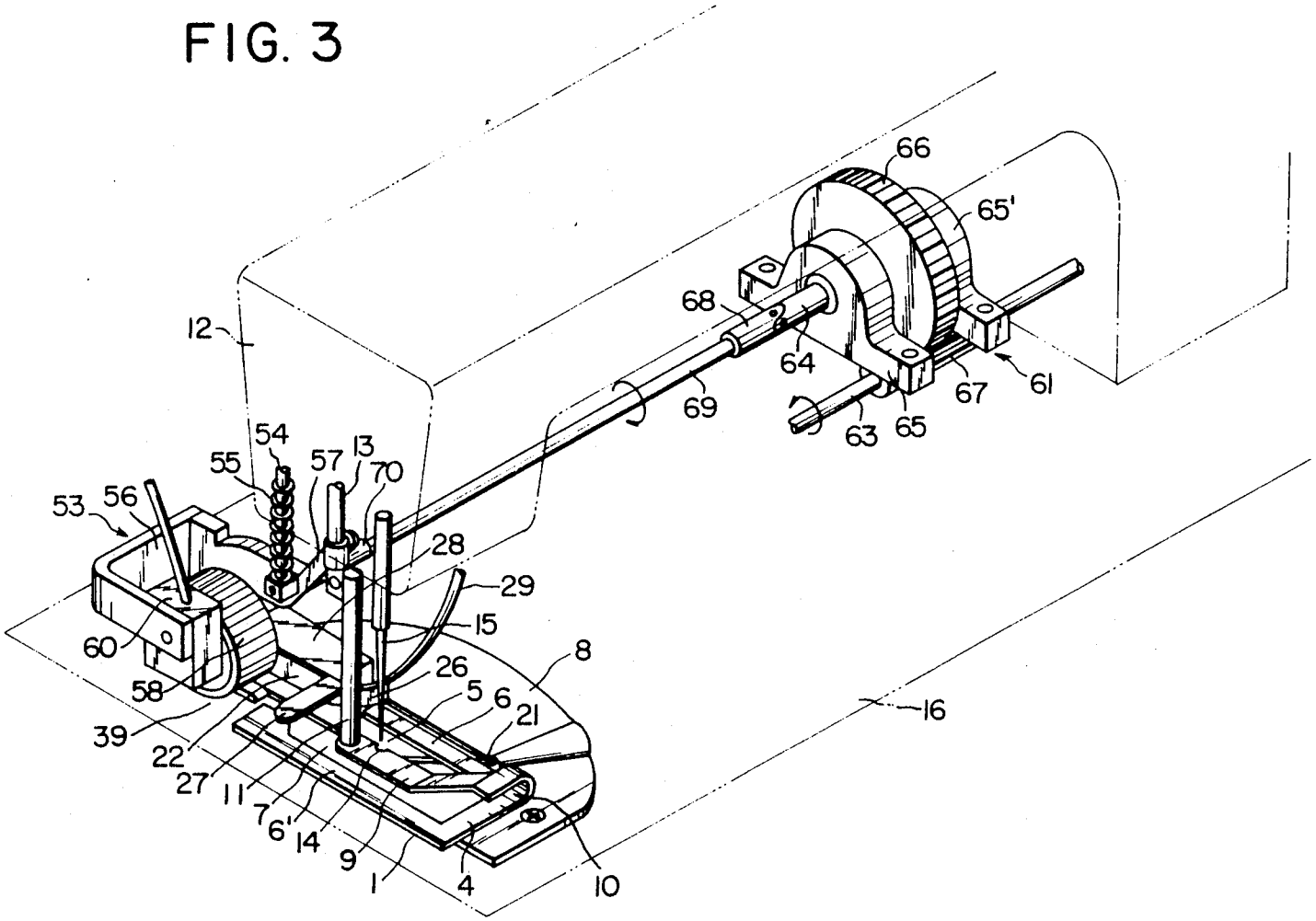
FIG. 3 is a perspective view of a mechanism in a sewing machine for pressing a seam open according to the present invention.
Figure 4:
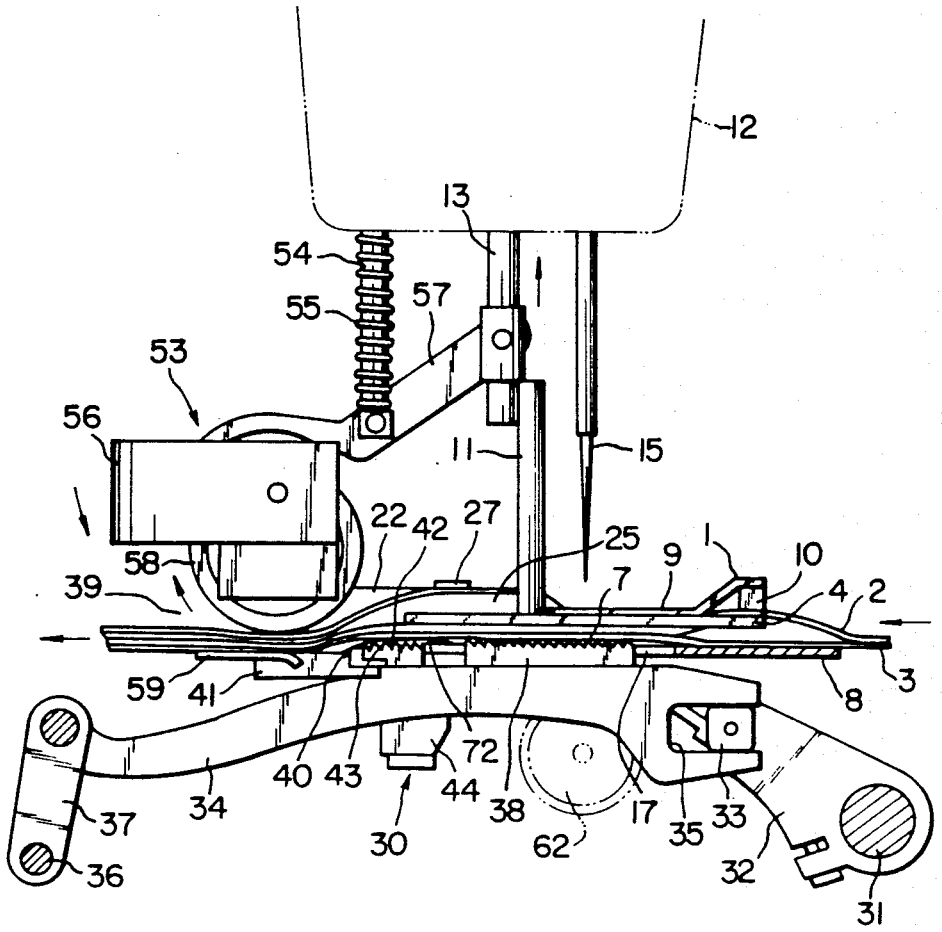
FIG. 4 is a front elevational view of the mechanism shown in FIG. 3.
Figure 5:
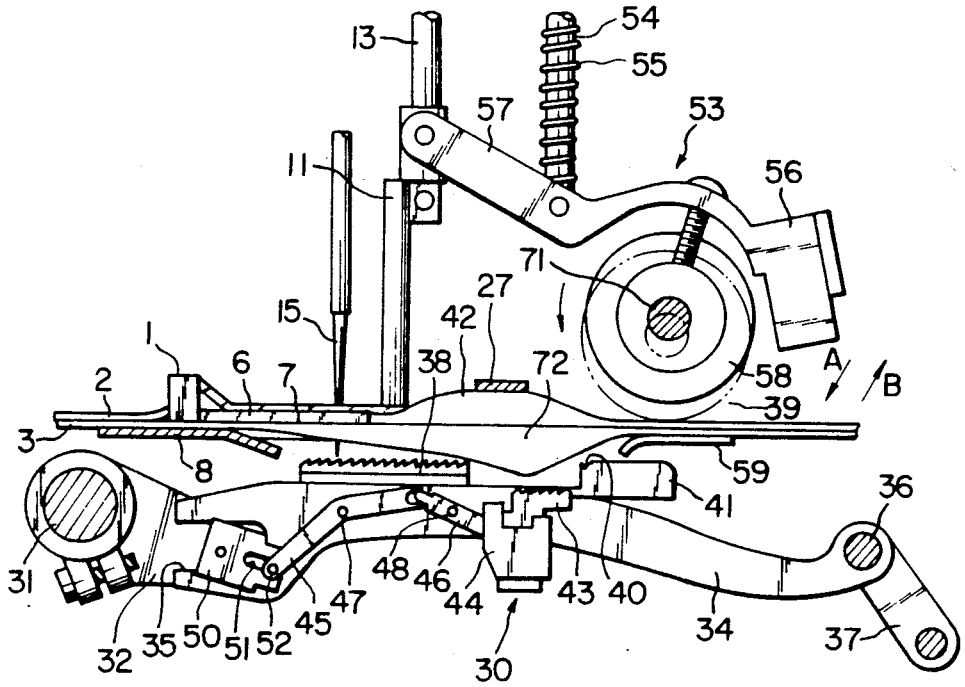
FIG. 5 is a rear elevational view of the mechanism of FIG. 3.
Figure 6:
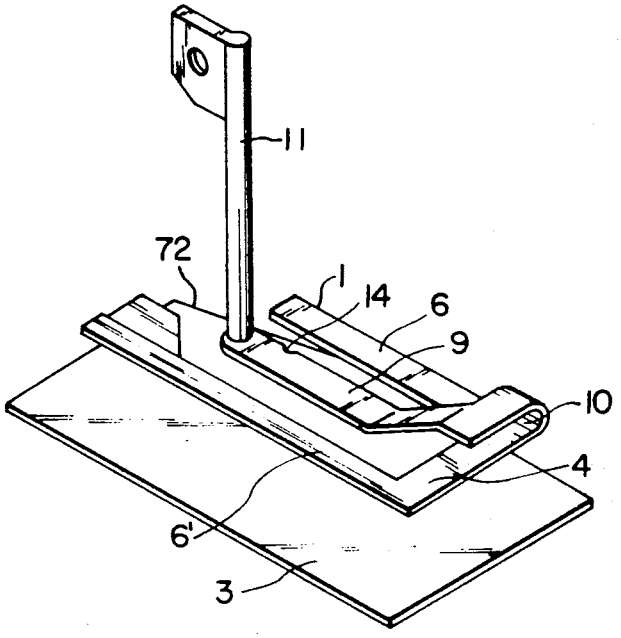
FIG. 6 is a perspective view of presser foot as it guides a lower piece of fabric.
Figure 7:
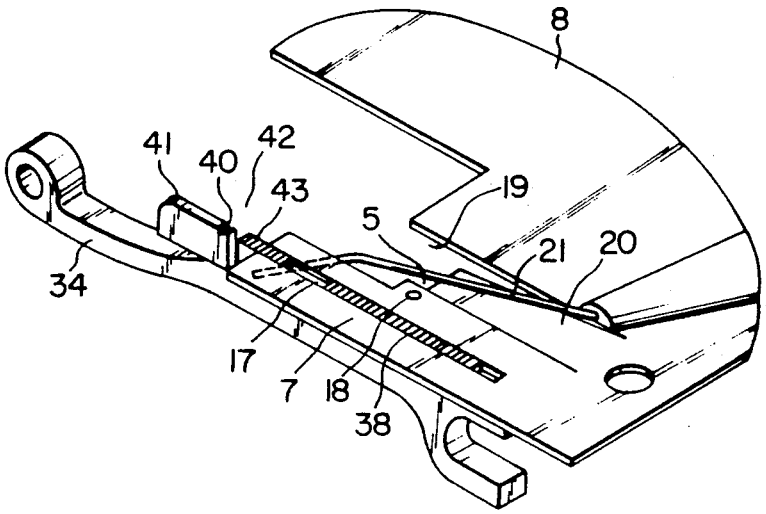
FIG. 7 is a perspective view of a throat plate and a feed bar.
Figure 8:
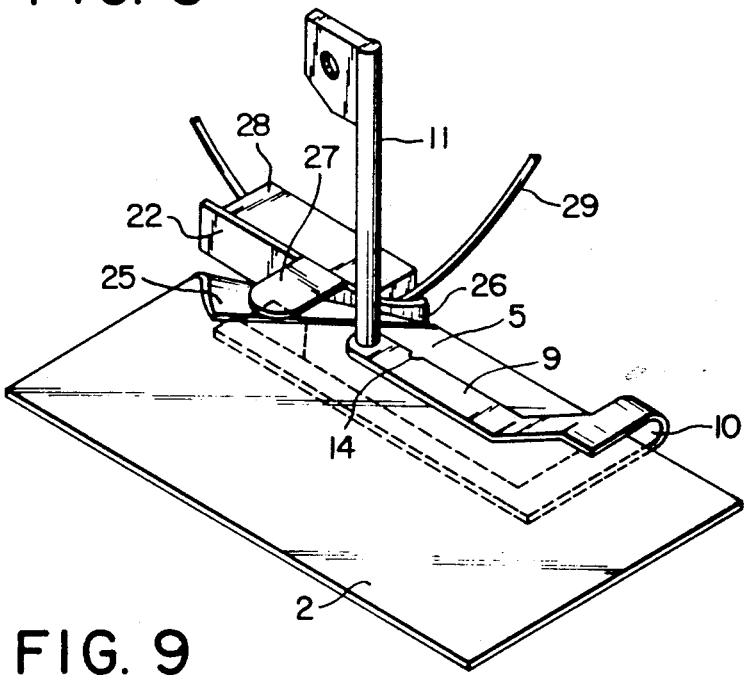
FIG. 8 is a perspective view illustrative of the manner in which an upper fabric piece is being folded back on itself.

As shown in FIGS. 3 through 5, a presser foot 1 has a partition 4 for separating upper and lower fabric pieces 2, 3 to be sewn together. The partition 4 has a pair of lower fabric guides 6, 6' extending from ends thereof and lying one on each side of a sewing position 5 (FIGS. 7 and 8). The presser foot 1 also includes a presser plate 9 disposed in overhanging relation to the sewing position 5 and a feeding position 7 for pressing the upper and lower fabric pieces 2, 3 down against a throat plate 8. The presser plate 9 has a rear end joined to an end of the partition 4 and raised obliquely to define a recess 10 for introducing therein the upper fabric piece 2. A support post 11 projects upwardly from a distal end of the presser plate 9 and has an upper end attached to a presser foot attachment rod 13 extending downwardly from a sewing machine body 12. The presser plate 9 has a needle slot 14 defined at the sewing position 5 for insertion therethrough of a sewing needle 15.

The throat plate 8 is mounted on a base plate 16 of the sewing machine body 12, and has a feed slot 17 at the feeding position 7 and a needle hole 18 at the sewing position 5. The throad plate 8 is also provided with a recess 19 lying below the lower fabric piece guide 6 of the presser foot 1. A guide plate 20 extends from an end edge of the recess 19 downwardly obliquely in the direction in which the fabric pieces are fed along, and a guide rod 21 projecting from a side edge downwardly obliquely along and over an upper surface of the guide plate 20 and having a distal end underlying the feed slot 17.

Figure 9:
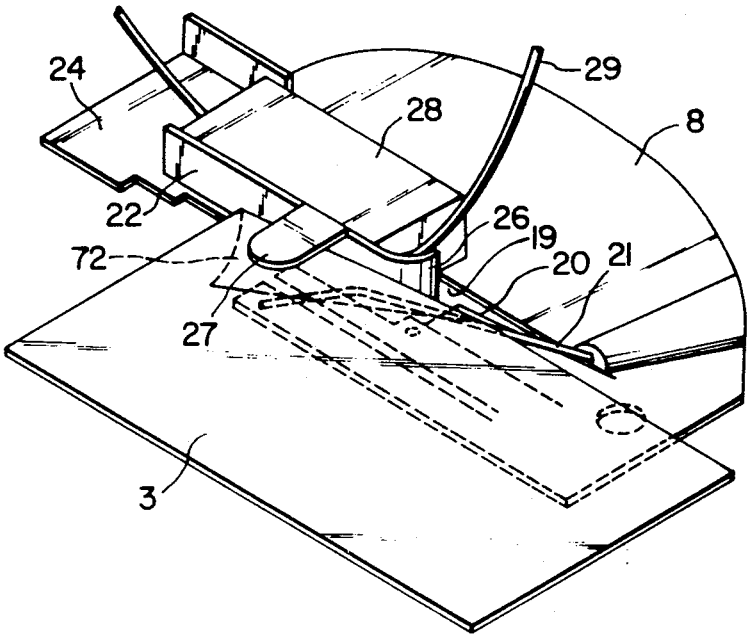
FIG. 9 is a perspective view illustrative of the manner in which a lower fabric piece is being folded back on itself.
Figure 10:
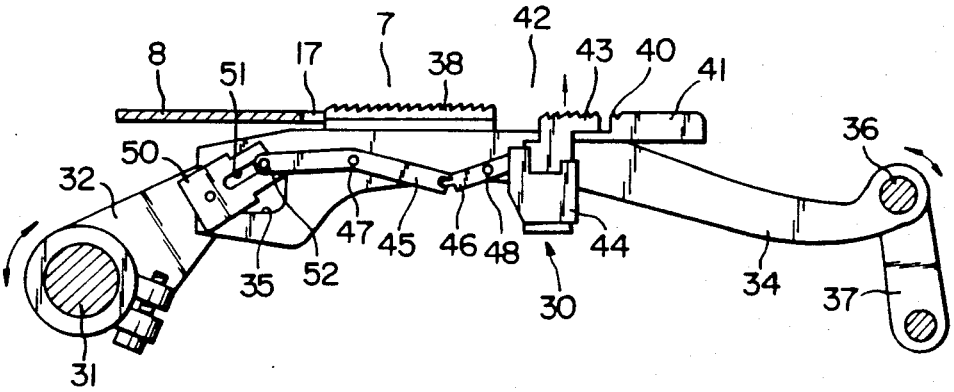
FIG. 10 is a rear elevational view of a fabric feeder mechanism.
Figure 13:
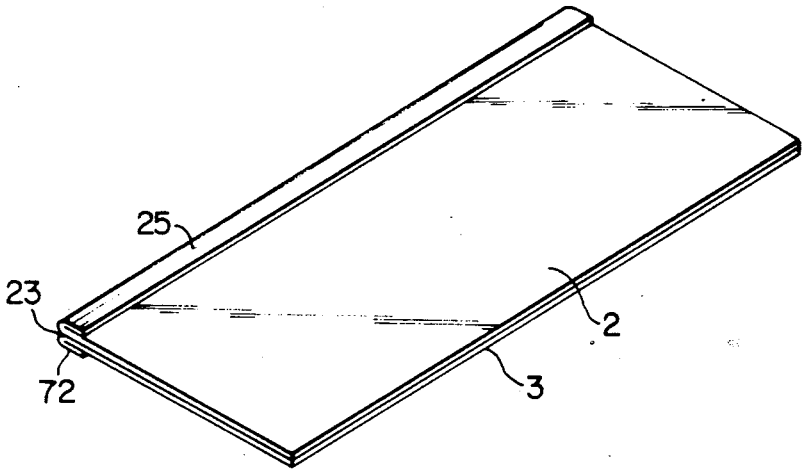
FIG. 13 is a perspective view of the upper and lower fabric pieces after they have been sewn together according to the present invention.

As shown in FIGS. 3, 8 and 9, a guide member 22 is mounted by an attachment plate 24 on the base plate 16 and extends from behind the sewing position 5 in the direction of feed of the fabric pieces for guiding the upper and lower fabric pieces 2, 3 while held in contact with a sewn seam 23 thereof (FIG. 13). The guide member 22 has on its end an integral guide 26 curved outwardly away from the presser foot 1 for guiding an end 25 of the upper fabric piece 2 to be directed upwardly, and an integral bent guide 27 projecting laterally from an upper edge of the guide member 22 in overhanging relation to the feed slot 17 in the throat plate 8 for subsequently guiding the end 25 of the upper fabric piece 2 to be successively folded back on itself, as best shown in FIG. 8. An electric heater body 28 is attached to the back of the guide member 22 in close contact therewith for heating the guide member 22 when the electric heater body 28 is electrically energized.

A steam nozzle 19 extends rearwardly of the guide member 22 and is directed toward the guide 26 for ejecting steam against the sewn seam 23 of the upper and lower fabric pieces 2, 3.

As illustrated in FIGS. 4 and 5, a fabric feeder mechanism 30 comprises a vertically swingable feeder body 32 secured to a shaft 31 angularly movable about its own axis and having on a distal end thereof a rocker 33 fittingly engaging in a U-shaped groove 35 defined in an end of a feeder base 34. The feeder base 34 has an opposite end pivotably coupled through a link 37 to a shaft 36 which is angularly movable about its own axis. The feeder base 34 is movable along a predetermined path of feeding movement in response to a given reciprocable angular motion of the shafts 31, 36.

Figure 11:
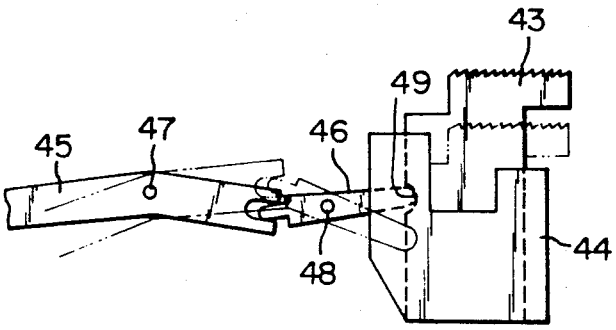
FIG. 11 is an enlarged view of a portion of the fabric feeder mechanism shown in FIG. 10.
Figure 12:
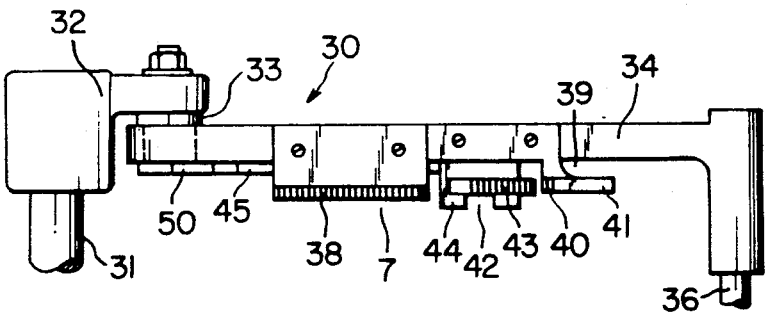
FIG. 12 is a plan view of the fabric feeder mechanism.

The feeder base 34 has on its upper surface a main feed dog 38 which can project through the feed slot 17 in the throat plate 8 in the feeding position 7 toward a lower surface of the presser plate 9 of the presser foot 1. The feeder base 34 also has a guide body 41 positioned in substantial vertical alignment with a pressing position 39 which is spaced a distance behind the feeding position 7 and in which the upper and lower fabric pieces 2, 3 are pressed together while being fed along, the guide body 41 having a guide tooth 40 on its distal end. An auxiliary feed dog 43, which is positioned between the main feed dog 38 and the guide body 41, is vertically slidably mounted by a guide bracket 44 on the feeder base 34, the auxiliary feed dog 43 being upwardly movable to an elevated position 42 lying horizontally between the feeding position 7 and the pressing position 39. A pair of longer and shorter levers 45, 46 are pivotably mounted on one side of the feeder base 34 by a pair of pins 47, 48, respectively, and have ends loosely interfitted with each other. The other end of the shorter lever 46 is fitted in a recess 49 (FIG. 11) defined in a side of a foot portion of the auxiliary feed dog 43, whereas the other end of the longer lever 45 has a pin 52 slidably received in a guide groove 51 formed in an actuator plate 50 fixed to the rocker 33 on the vertically swingable feeder body 32. This arrangement enables the auxiliary feed dog 43 to be moved up and down through the levers 45, 46 in response to reciprocable swinging movement of the feeder body 32.

A roller mechanism 53 is located in the pressing position 39. A roller attachment rod 54 that is vertically movable depends from the sewing machine body 12 behind the presser foot attachment rod 13 and is normally urged to its lowermost position by a compression coil spring 55 disposed around the roller attachment rod 54 between its lower end and the sewing machine body 12 under compression. A generally U-shaped roller bracket 56 has an arm pivotably mounted on the lower end of the roller attachment rod 54 and having an integral bar 57 pivotably attached to the presser foot attachment rod 13. The roller bracket 56 is thus pivotably movable up and down about the lower end of the roller attachment rod 54 in response to vertical movement of the presser foot attachment rod 13 which is caused when the presser foot 1 moves up and down on feeding movement of the main feed dog 38.

A roller 58 is rotatably supported on the roller bracket 56 and positioned in confronting relation to and upwardly of a bearing plate 59 mounted on the base plate 18 at the pressing position 39. The roller 58 is movable into and out of contact with an upper surface of the bearing plate 59 in response to vertical pivotable movement of the roller bracket 56. An electric heater body 60 is attached to the other arm of the roller bracket 56 adjacent to the roller 58 for heating the roller 58.

A roller drive mechanism 61 is mounted on the base plate 16 and includes a drive shaft 64 journalled by a pair of bearings 65, 65' and extending parallel to a lower shaft 63 for rotating a bobbin 62 (FIG. 4) in the sewing machine body 12. A gear 66 is mounted on the drive shaft 64 and held in mesh with a drive gear 67 mounted on the lower shaft 63 through the base plate 16. To the drive shaft 64, there is connected by a universal joint 68 an end of a coupling shaft 69 the other end of which is connected by a universal joint 70 to a central shaft 71 of the roller 58. Accordingly, the roller 58 can be driven by the lower shaft 63 to rotate in the direction of feed of the fabric pieces.

Operation of the sewing machine thus constructed for pressing a sewn seam open will be described. The upper fabric piece 2 placed over the lower fabric piece 3 is fed through the recess 10 in the presser foot 1 and between the presser plate 9 and the throat plate 8 at the sewing position 5. At the same time, the lower fabric piece 3 is passed under the partition 4 of the presser foot 1 so as to be separated from the upper fabric piece 2 and is inserted between the presser plate 9 and the throat plate 8. The lower fabric piece 3 has an edge 72 sandwiched between the guide plate 20 and the guide rod 21 so that the edge 72 will be brought under the throat plate 8.

When the sewing machine is then operated to start sewing operation, the upper and lower fabric pieces 2, 3 are sewn together in the sewing position 5. The fabric feeder mechanism 30 is actuated to cause the main feed dog 38 to ascend through the feed slot 17 in the throat plate 8 and simultaneously to move horizontally in the feeding direction for successively transferring the upper and lower fabric pieces 2, 3 sandwiched between the presser plate 9 and the main feed dog 38. As illustrated in FIG. 8, the edge 25 of the upper fabric piece 2 as it progressively advances is brought against the guide surface 26 at the distal end of the guide member 22 and raised thereby. The edge 25 is then successively folded back on itself by the guide 27. As shown in FIG. 9, the edge 72 of the lower fabric piece 3, while being fed along, is guided by the guide rod 21 so as not to be caught by the bobbin 62 and is folded back on itself by the guide rod 21 below the throat plate 8. In FIG. 5, the edge 72 of the lower fabric piece 3 is lifted toward the throat plate 8 in the elevated position 42 by the auxiliary feed dog 43 which is raised by the levers 45, 46 in response to upward angular movement of the feeder body 32 when the fabric feeder mechanism 30 operates. The edge 72 is then guided successively onto the bearing plate 59 in the pressing position 39 by the guide body 41 which is disposed behind the auxiliary feed dog 43 and ganged with the main feed dog 38.

The sewn seam 23 of the upper and lower fabric pieces 2, 3 as they are overlapped in the elevated position 42 and sewn and folded back on themselves is moistened by steam ejected from the steam nozzle 29 while the seam 23 is being guided by the guide member 22, and is folded firmly by the guide member 22 which is heated by the electric heater body 28. The total of four layers composed of the upper and lower fabric pieces 2, 3 and their folded edges 25, 72 are sandwiched between the roller 58 and the bearing plate 59. The upper and lower fabric pieces 2, 3 are forcibly pulled on by rotation of the roller 58 in the feeding dirrection which is driven by the roller drive mechanism 61, whereupon the seam edges of the upper and lower fabric pieces 2, 3 are pressed with heat by the roller 58 that is heated by the electric heater body 60. Therefore, the upper and lower fabric pieces 2, 3 are successively sewn together with their edges 25, 72 completely folded back against the fabric pieces 2, 3, as shown in FIG. 13.

Since the roller 58 is pivotably supported by the roller bracket 56 on the roller attachment rod 54 and the bar 57 integral with the roller bracket 56 is pivotably mounted on the presser foot attachment rod 13, the roller bracket 56 is angularly moved in the direction of the arrow A (FIG. 5) about the lower end of the roller attachment rod 54 when the main feed dog 38 is raised through the feed slot 17 in the throat plate 8 to push the presser plate 9 of the presser foot 1 upwardly on feeding movement of the fabric feeder mechanism 30. Consequently, the roller 58 is caused to descend to press the upper and lower fabric pieces 2, 3 and pull them on rotation of the roller 58. When the main feed dog 38 is lowered while the fabric pieces 2, 3 are being sewn to each other, the roller bracket 56 is then forced to move upwardly in the direction of the arrow B, whereupon the roller 58 is elevated clear of pressing engagement with the upper fabric piece 2, releasing the upper and lower fabric pieces 2, 3 which are freed from undue forces during their being sewn together. When more fabric layers than normal are present in the pressing position 39, the roller bracket 56 is allowed to be raised against the resilient force from the spring 55 for thereby lifting the roller 58 to protect the fabric pieces from being subjected to an excessively strong force.

With the arrangement of the present invention, the upper and lower fabric pieces 2, 3 as they are progressively sewn together are separated by the partition 4 and pressed together by the presser plate 9 in the feeding position 7. The edge 72 of the lower fabric piece 3 can automatically be folded back below the throat plate 8 by the guide rod 21. The sewn seam 23 of the upper and lower fabric pieces 2, 3 is guided by the guide member 22, which extends from the sewing position 5 in the feeding direction to automatically fold back the edge 25 of the upper fabric 2. The guide member 22 which is heated by the electric heater body 28 can heat and uniformly set the seam 23 of the upper and lower fabric pieces 2, 3. The folded edge 72 of the lower fabric piece 3 which is guided below the throat plate 8 can be automatically brought back to the throat plate 8 by the auxiliary feed dog 43 which is lifted by the levers 45, 46 when the feeder body 32 is elevated during fabric feeding operation. The guide body 41 is movable in unision with the main feed dog 38 to guide the edge 72 of the lower fabric piece 3 reliably onto the bearing plate 59 in the pressing position 39. The overlapped upper and lower fabric pieces 2, 3 with their folded edges 25, 72 are pressed firmly with heat and pulled along by the roller 58 which is located above the bearing plate 59 and heated by the electric heater body 60. Accordingly, the sewn seam 23 can completely and uniformly be pressed open by the roller 58. Application of steam to the sewn seam 23 through the steam nozzle 29 when the seam 23 is pressed by the roller 58 also facilitates permanent setting of the seam 23.

The roller 38 is movable downwardly to press the upper and lower fabric pieces 2, 3 only when the main feed dog 38 is raised toward the presser foot 1 to feed the fabric pieces 2, 3. During sewing operation, the roller 58 is lifted to release the fabric pieces 2, 3, which are then free of any undue pulling forces. The roller 58 can also be raised when the sewing machine fails to operate due to some trouble or malfunction on sewing, so that the upper fabric piece 2 can be protected from being excessively heated by the heated roller 58. With the roller 58 resiliently lowered under the force of the spring 55, the roller 58 can be moved upwardly when an undue number of fabric layers happen to be introduced in the pressing position 39, so that the fabric layers will not undergo unwanted excessive pressing forces.

The fully automated, continuous process of sewing the upper and lower fabric pieces 2, 3 with each other, folding back the edges 25, 72, and pressing the sewn seam 23 with heat on the sewing machine can dispense with any manual ironing of sewn seams which has been required conventionally. The method and apparatus according to the present invention is therefore a great labor saver, and is capable of producing sewn fabric materials with uniform and sightly sewn seams which are mechanically pressed open.

Although a certain preferred embodiment has been shown and described, it should be understood that many changes and modifications may be made therein without departing from the scope of the appended claims.

What is claimed is:

1. A method of pressing open a sewn seam of upper and lower fabric pieces on a sewing machine, comprising the steps of:
   - separating the upper and lower fabric pieces by means of a presser foot;
   - sewing the upper and lower fabric pieces along a seam with respective edges left along said seam;
   - feeding the upper and lower fabric pieces in a specific direction on a main feed dog;
   - folding back the edge of the upper fabric piece on the latter by means of a guide member disposed above a throat plate;
   - heating the guide member to heat the seam;
   - folding back the edge of the lower fabric piece on the latter below the throat plate by means of a guide rod mounted on the throat plate;
   - lifting the folded edge of the lower fabric piece up to the throat plate by means of an auxiliary feed dog;
   - guiding the folded edge of the lower fabric piece onto a bearing plate by means of a guide body movable with the main feed dog; and
   - pressing the upper and lower fabric pieces with their folded edges with heat between a roller and the bearing plate while rotating the roller to move the upper and lower fabric pieces in said direction.

2. A method according to claim 1, including the step of applying steam to the seam when the latter is heated by the guide member.

3. An apparatus for pressing open a sewn seam of upper and lower fabric pieces on a sewing machine, comprising:
   - a sewing machine body having a base plate including a bearing plate;
   - a presser foot mounted on said sewing machine body and having a partition for separating the upper and lower fabric pieces and a presser plate for pressing them together;
   - means on said sewing machine body for sewing the upper and lower fabric pieces as they are pressed by said presser plate, along a seam with respective edges thereof left along the seam;
   - means below said base plate for feeding the upper and lower fabric pieces in a specific direction;

a guide member mounted on said base plate for guiding the sewn seam and folding back the edge of the upper fabric piece;

a throat plate mounted on said base plate and having a guide rod for folding back the edge of the lower fabric piece away from the edge of the upper fabric piece; and a roller rotatably mounted on said sewing machine body for pressing the upper and lower fabric pieces with their folded edges against said bearing plate and drivable to move the upper and lower fabric pieces in said direction.

4. An apparatus according to claim 3, wherein said feeding means comprises a swingable feeder body, a feeder base angularly actuatable by said swingable feeder body, a main feed dog mounted on said feeder base for feeding the upper and lower fabric pieces in said direction, an auxiliary feed dog vertically movably mounted on said feeder base and operatively coupled through at least one lever to said swingable feeder body for lifting the edge of the lower fabric piece up to said throat plate, and a guide body mounted on said feeder base and movable with said main feed dog for guiding the edge of the lower fabric piece as lifted by said auxiliary feed dog onto said bearing plate below said roller.

5. An apparatus according to claim 3, including a first electric heater body attached to said guide member for heating the sewn seam when it is guided by said guide member and a second electric heater body attached to said roller for heating the upper and lower fabric pieces when they are presser by said roller.

6. An apparatus according to claim 3, including a steam nozzle directed toward said guide member for ejecting steam against the sewn seam.

7. An apparatus according to claim 3, wherein said roller mechanism is disposed on said sewing machine body and comprises a roller bracket which said roller is rotatably supported, and a roller attachment rod mounted on said sewing machine body and extending toward said base plate, said roller bracket being pivotably supported on said roller attachment rod, said sewing machine having a vertically movable presser foot attachment rod on which said presser foot is supported, said roller bracket having a bar pivotably mounted on said presser foot attachment rod.

8. An apparatus according to claim 7, wherein said roller attachment rod is vertically movable, said roller mechanism also including a spring acting between said sewing machine body and said roller attachment rod for normally urging the latter in a direction to displace said roller toward said bearing plate.

* * * * *